US008066652B2

(12) United States Patent
Wu et al.

(10) Patent No.: US 8,066,652 B2
(45) Date of Patent: Nov. 29, 2011

(54) MASSAGE DEVICE WITH A HOIST TRANSMISSION MECHANISM

(75) Inventors: Chichun Wu, Dongguan (CN); Zhao Zhang, Dongguan (CN); Chi-Wu Chiang, Dongguan (CN)

(73) Assignee: Weightec Electronic Technology Co., Ltd., Guangdong Province (CN)

( * ) Notice: Subject to any disclaimer, the term of this patent is extended or adjusted under 35 U.S.C. 154(b) by 815 days.

(21) Appl. No.: 12/145,330

(22) Filed: Jun. 24, 2008

(65) Prior Publication Data

US 2009/0270780 A1 Oct. 29, 2009

Related U.S. Application Data

(63) Continuation-in-part of application No. 12/103,785, filed on Apr. 16, 2008.

(60) Provisional application No. 61/048,688, filed on Apr. 29, 2008.

(51) Int. Cl.
*A61H 15/00* (2006.01)

(52) U.S. Cl. ..... 601/87; 601/84

(58) Field of Classification Search ..... 601/84, 601/87, 100–103, 112, 113, 116
See application file for complete search history.

(56) References Cited

U.S. PATENT DOCUMENTS 5,265,590 A 11/1993 Tagagi
5,460,598 A 10/1995 Yamasaki et al.
6,454,731 B1 9/2002 Marcantoni
D491,375 S 6/2004 Yuyama
6,808,500 B1 10/2004 Cheng-Yi et al.
6,849,054 B1 2/2005 Kim
6,890,313 B2 5/2005 Kim
6,916,300 B2 7/2005 Hester et al.
D517,337 S 3/2006 Mori
7,014,620 B2 3/2006 Kim
7,018,347 B2 3/2006 Kim
7,037,279 B2 5/2006 Kim
7,048,701 B2 5/2006 Kim
7,052,475 B2 5/2006 Kim
7,052,476 B2 5/2006 Kim
7,081,098 B2 7/2006 Kim
7,081,099 B1 7/2006 Luo
7,081,100 B2 7/2006 Kim
7,108,669 B2 9/2006 Huang
7,108,670 B2 9/2006 Huang
7,118,541 B2 10/2006 Kim
7,120,947 B1 10/2006 Magallanes
7,125,389 B2 10/2006 Sin
7,128,721 B2 10/2006 Ferber et al.
D531,424 S 11/2006 Kusachi
7,160,261 B1 1/2007 Huang
7,179,240 B2 2/2007 Wu
7,207,957 B2 4/2007 Szczepanski
7,264,598 B2 9/2007 Shin
7,347,833 B2 3/2008 Kim (Continued)

*Primary Examiner* — Michael A. Brown
(74) *Attorney, Agent, or Firm* — Morris Manning & Martin LLP; Tim Tingkang Xia, Esq.

(57) ABSTRACT

The present invention relates to a massage device. In one embodiment, the massage device includes a massage assembly and a transmission assembly for driving the massage assembly to provide massage effects. The massage assembly includes a pair of massage members. Each massage member has a driving member having a pair of eccentric gears, a massage bracket engaged with the driving member and a plurality of massage heads attached to the massage bracket. The transmission assembly includes a hoist transmission mechanism.

20 Claims, 6 Drawing Sheets

U.S. PATENT DOCUMENTS

| | | | | |
|---|---|---|---|---|
| D565,855 | S | 4/2008 | Takahashi et al. | |
| 7,947,002 | B2 * | 5/2011 | Mizoguchi et al. | 601/99 |
| 2004/0243034 | A1 | 12/2004 | Kim | |
| 2005/0049530 | A1 | 3/2005 | Kim | |
| 2005/0049531 | A1 | 3/2005 | Kim | |
| 2005/0101890 | A1 * | 5/2005 | Mizoguchi et al. | 601/84 |
| 2007/0149906 | A1 * | 6/2007 | Mizoguchi et al. | 601/84 |
| 2007/0208284 | A1 | 9/2007 | Huang | |
| 2008/0048475 | A1 | 2/2008 | Tanizawa et al. | |
| 2008/0051683 | A1 | 2/2008 | Tanizawa | |
| 2009/0227915 | A1 * | 9/2009 | Chiang | 601/115 |
| 2009/0270778 | A1 * | 10/2009 | Wu et al. | 601/97 |

* cited by examiner

MASSAGE DEVICE WITH A HOIST TRANSMISSION MECHANISM

CROSS-REFERENCE TO RELATED PATENT APPLICATION

This application is a continuation-in-part of U.S. patent application Ser. No. 12/103,785, filed Apr. 16, 2008, entitled "A Massage Device," by Chi-Wu Chiang, the disclosure for which is incorporated herein by reference in its entirety, which itself claims priority to and the benefit of, pursuant to 35 U.S.C. 119(a), Chinese patent application Serial No. 200820091616.4, filed Mar. 7, 2008, entitled "A Massage Device," by Chi-Wu Chiang, which is incorporated herein by reference in its entirety. This application also claims priority to and the benefit of, pursuant to 35 U.S.C. §119(e), of provisional U.S. patent application Ser. No. 61/048,688, filed Apr. 29, 2008, entitled "Massage Device With a Hoist Transmission Mechanism," by Chichun Wu and Zhao Zhang, which is incorporated herein by reference in its entirety.

FIELD OF THE INVENTION

The present invention relates generally to a massage device, and more particularly to a massage device that utilizes a hoist transmission mechanism to provide massaging effects.

BACKGROUND OF THE INVENTION

Simulated massaging or kneading of parts of the body to aid circulation or relax the muscles has gained popularity, particularly, among people who are lack of exercise. The simulated massaging or kneading effects can be achieved electromagnetically and/or mechanically by means of a massage device. For the electromagnetic massaging or kneading, such a massage device is configured to generate a series of electromagnetic pulses, which are regularly directed to parts of interest of the body so as to perform massaging or kneading thereon. However, the massaging or kneading area of the massage device is limited, and the massaging or kneading effects may not be very gentle.

For the mechanical massaging or kneading, the massage device is usually designed to have a plurality of massage nodes and a driving system to drive the plurality of massage nodes to rotate so as to simulate massaging or kneading when applied to parts of interest of the body. Comparing to the electromagnetic massaging, the limitation of the massaging or kneading area is improved for the mechanical massaging. However, mechanical massage devices are relatively complex and costly.

Therefore, a heretofore unaddressed need exists in the art to address the aforementioned deficiencies and inadequacies.

SUMMARY OF THE INVENTION

The present invention, in one aspect, relates to a massage device. In one embodiment, the massage device has a base cover having a first end portion and an opposite, second end portion, a longitudinal axis and a plurality of guiding rails formed parallel to the longitudinal axis.

The massage device also has a carriage. The carriage in one embodiment includes a chassis member having a first surface and an opposite, second surface, a shield member having a first surface and an opposite, second surface, a chamber defined between the second surface of the chassis member and the first surface of the shield, a plurality of grooves formed in the first surface of the chassis member, and a pair of receiving member each having a pair of bolt shafts protruded from the second surface of the shield member and a bore formed through the first surface and the second surface of the shield member. When the carriage is engaged with the base cover, the plurality of guiding rails is received in the plurality of grooves of the chassis member, respectively, and the carriage is longitudinally movable back and forth along the plurality of guiding rails of the base cover.

Furthermore, the massage device has a transmission assembly received in the chamber and secured in the carriage. The transmission assembly includes a motor having an output shaft, a worm mechanically coupled with the output shaft of the motor, a pair of first worm wheels meshing with the worm, a pair of second worm wheels each meshing with a corresponding one of the pair of first worm wheels, a first gear coaxially mounted under one of the pair of second worm wheels, a second gear meshing with the first gear and a third gear meshing with the second gear.

The transmission assembly further includes a hoist transmission mechanism having a reel wheel coaxially mounted to the third gear, a pair of pulleys respectively mounted to the first end portion and the second portion of the base cover, and a cable routed over the pair of pulleys and wound on the reel wheel, thereby defining a first distance. L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased, while the other of the first distance L1 and the second distance L2 to be increased, where L1+L2=L>L3. In one embodiment, the cable is made of leather, plastic, steel, or alloy.

When the motor is activated, it drives the worm to rotate, the rotation of the worm results in, in turn, the rotations of the pair of first worm wheels, the pair of second worm wheels, the first gear, the second gear, and the third gear, and the reel wheel, the rotation of the reel wheel causes one of the first distance L1 and the second distance L2 to be decreased, while the other of the first distance L1 and the second distance L2 to be increased, thereby moving the carriage along the plurality of the guiding rails of the base cover.

Moreover, the massage device has a massage assembly having a pair of massage members. Each massage member includes:

(i) a driving member having a pair of eccentric gears and a driving gear, configured such that when the driving member is received in a corresponding receiving member of the carriage, each of the pair of eccentric gears is coaxially and rotatably engaged with a corresponding one bolt shaft of the receiving member and meshed with the driving gear, where each of the pair of eccentric gears has a protrusion protruded at an eccentric position;

(ii) a gear shaft extending through the bore of the corresponding receiving member of the carriage, having a first end portion and an opposite, second end portion coaxially mounted to the driving gear and the corresponding second worm wheel, respectively;

(iii) a massage bracket having a first end portion and a second portion defining a bracket body therebetween, where the bracket body defines a pair of openings, such that when the massage bracket is attached to the driving member, the protrusion of each of the pair of eccentric gears of the driving member is received in a corresponding opening; and (iv) a pair of massage heads mounted to the first end portion and the second end portion, respectively, of the massage bracket. In one embodiment, each of the pair of massage heads has a mushroom-shape. In another embodiment, each of the pair of massage heads comprises a structure and a mushroom-shape node housing the structure. Each of the pair of massage heads comprises an energy source of capable of generating at least one thermal energy and photonic energy, where the source energy comprises a lamp base, a PCB board attached to the lamp base, and heating lamps attached onto the PCB board.

When the corresponding second worm wheel rotates, it causes the gear shaft to rotate, the rotation of the gear shaft results in, in turn, the rotation of the driving gear and the pair of eccentric gears, the rotation of pair of eccentric gears drives the pair of massage heads to move synchronically in a circle, thereby providing a kneading effect to a user.

In another aspect, the present invention relates to a massage device. In one embodiment, the massage device has a massage assembly and a transmission assembly.

The massage assembly has a pair of massage members. Each massage member includes a massage bracket having a first end portion and a second portion defining a bracket body therebetween, where the bracket body defines a pair of openings, a driving member having a pair of eccentric gears and a driving gear meshing with the pair of eccentric gears, where each of the pair of eccentric gears has a protrusion protruded at an eccentric position, where the protrusion of the eccentric gear is received in a corresponding opening of the massage bracket, and a pair of massage heads mounted to the first end portion and the second end portion, respectively, of the massage bracket. In one embodiment, each of the plurality of massage heads has an energy source of capable of generating at least one of thermal energy and photonic energy.

The transmission assembly is adapted for driving each massage head of the massage assembly to move along a circle, while translating the massage assembly along a direction parallel to the planar of the circle.

In one embodiment, the massage device may further has a base cover having a first end portion and an opposite, second end portion, a longitudinal axis and a plurality of guiding rails formed parallel to the longitudinal axis. The massage device may also has a carriage. The carriage includes a chassis member having a first surface and an opposite, second surface, a shield member having a first surface and an opposite, second surface, a chamber defined between the second surface of the chassis member and the first surface of the shield, a plurality of grooves formed in the first surface of the chassis member, and a pair of receiving member each having a pair of bolt shafts protruded from the second surface of the shield member and a bore formed through the first surface and the second surface of the shield member. When the carriage is engaged with the base cover, the plurality of guiding rails is received in the plurality of grooves of the chassis member, respectively, and the carriage is longitudinally movable back and forth along the plurality of guiding rails of the base cover.

In one embodiment, the transmission assembly is received in the chamber and secured in the carriage. The transmission assembly includes a motor having an output shaft, a worm mechanically coupled with the output shaft of the motor, a pair of first worm wheels meshing with the worm, a pair of second worm wheels each meshing with a corresponding one of the pair of first worm wheels, a first gear coaxially mounted under one of the pair of second worm wheels, a second gear meshing with the first gear, and a third gear meshing with the second gear. The transmission assembly may further include a hoist transmission mechanism having a reel wheel coaxially mounted to the third gear, a pair of pulleys respectively mounted to the first end portion and the second portion of the base cover, and a cable routed over the pair of pulleys and wound on the reel wheel, thereby defining a first distance. L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased, while the other of the first distance L1 and the second distance L2 to be increased, where L1+L2=L>L3. The cable is made of leather, plastic, steel, or alloy.

When the motor is activated, it drives the worm to rotate, the rotation of the worm results in, in turn, the rotations of the pair of first worm wheels, the pair of second worm wheels, the first gear, the second gear, and the third gear, and the reel wheel, the rotation of the reel wheel causes one of the first distance L1 and the second distance L2 to be decreased, while the other of the first distance L1 and the second distance L2 to be increased, thereby moving the carriage along the plurality of the guiding rails of the base cover.

In one embodiment, each massage member may further comprise a gear shaft extending through the bore of the corresponding receiving member of the carriage, having a first end portion and an opposite, second end portion coaxially mounted to the driving gear and the corresponding second worm wheel, respectively.

In operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the pair of massage heads to move along a circle, thereby providing a kneading effect to a user.

In yet another aspect, the present invention relates to a massage device. In one embodiment, the massage device includes a massage assembly having a plurality of massage heads, and a transmission assembly having a first transmission mechanism and a second transmission mechanism.

In one embodiment, the second transmission mechanism has a reel wheel coupled to the first transmission, a pair of pulleys spatially mounted to a base cover, and a cable routed over the pair of pulleys and wound on the reel wheel, thereby defining a first distance. L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased, while the other of the first distance L1 and the second distance L2 to be increased, where L1+L2=L>L3.

The first transmission mechanism is coupled to the massage assembly so as to drive each massage head of the massage assembly to move along a circle, and also drive the reel wheel of the second transmission mechanism to rotate, thereby translating the massage assembly along a direction parallel to the planar of the circle.

In one embodiment, the first transmission mechanism may include a motor having an output shaft, a worm mechanically coupled with the output shaft of the motor, a pair of first worm wheels meshing with the worm, a pair of second worm wheels each meshing with a corresponding one of the pair of first worm wheels, a first gear coaxially mounted under one of the pair of second worm wheels, a second gear meshing with the first gear, and a third gear meshing with the second gear. The reel wheel of the second transmission mechanism is coaxially mounted to the third gear.

When the motor is activated, it drives the worm to rotate, the rotation of the worm results in, in turn, the rotations of the pair of first worm wheels, the pair of second worm wheels, the first gear, the second gear, and the third gear, and the reel wheel.

In one embodiment, the massage assembly may further comprise at least one massage bracket having a first end portion and a second portion defining a bracket body therebetween, where the plurality of massage heads is mounted to the first and second end portions, and where the bracket body defines a pair of openings, and at least one driving member having a pair of eccentric gears and a driving gear meshing with the pair of eccentric gears, where each of the pair of eccentric gears has a protrusion a protruded at an eccentric position that is received in a corresponding opening of the massage bracket. Additionally, the massage assembly may also comprise a gear shaft, having a first end portion and an opposite, second end portion coaxially mounted to the driving gear of the driving member and the corresponding second worm wheel of the first transmission mechanism, respectively.

In operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the pair of massage heads to move along a circle, thereby providing a kneading effect to a user.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
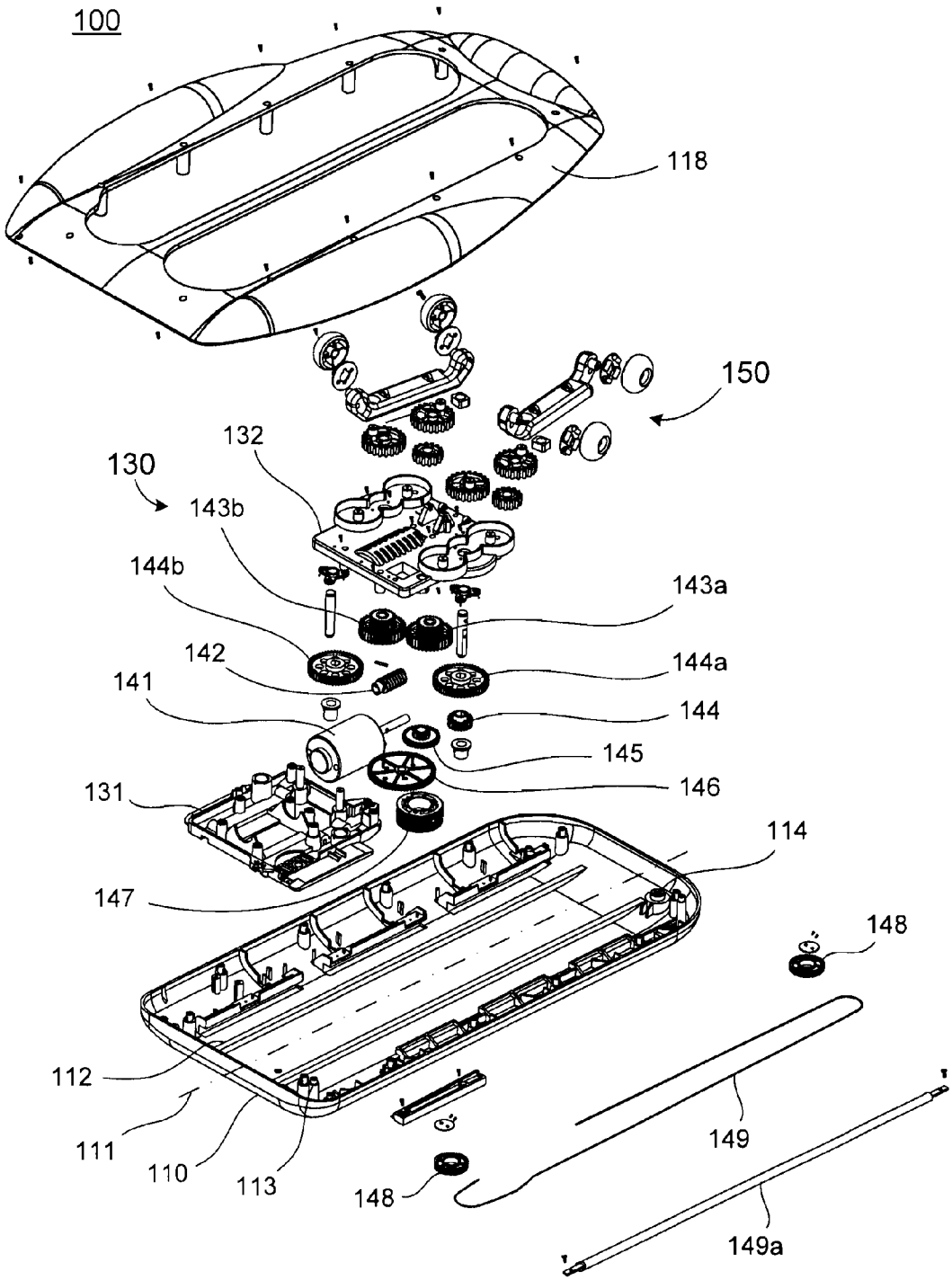
FIG. 1 shows an exploded view of a massage device according to one embodiment of the present invention.
Figure 2:
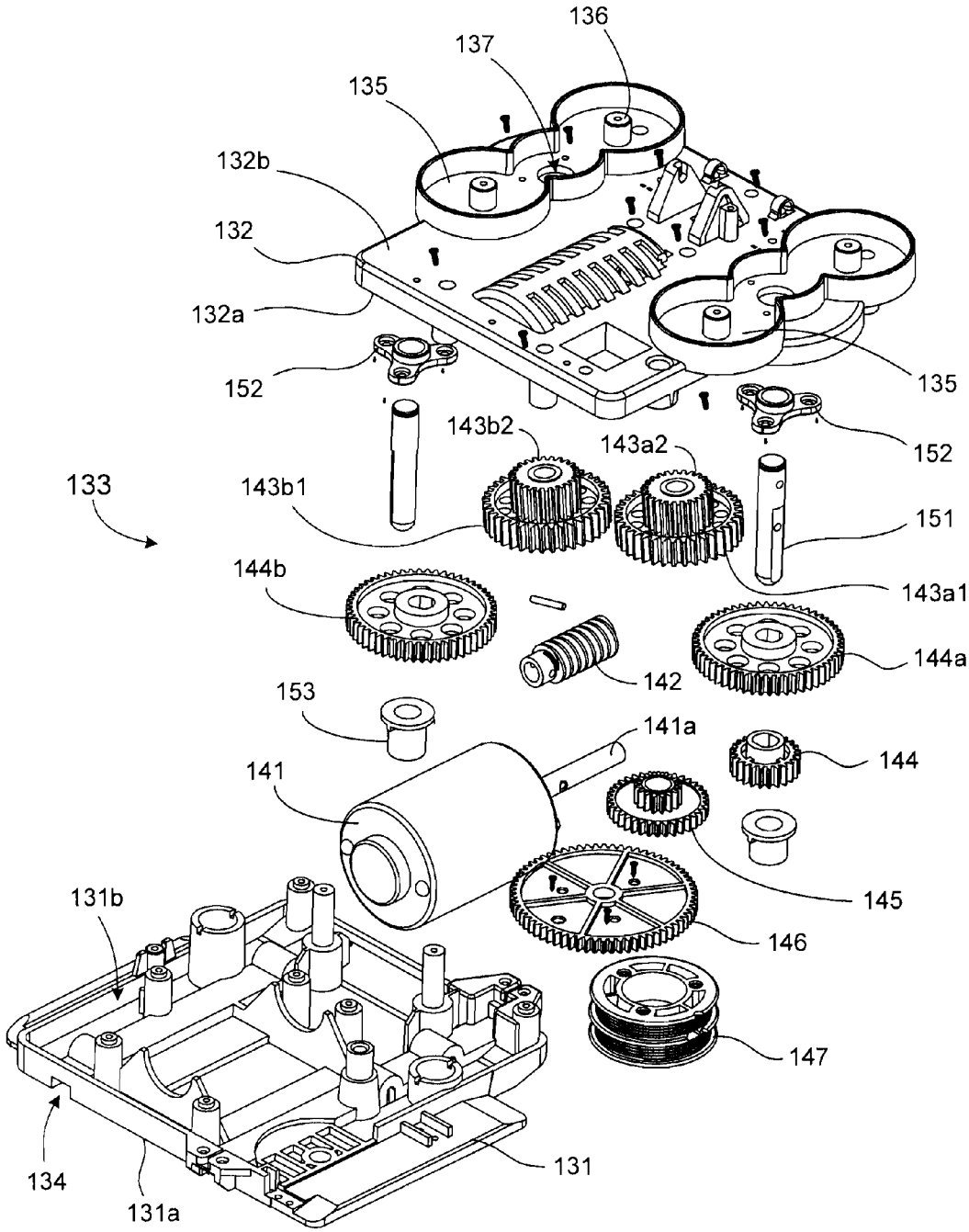
FIG. 2 shows a partially exploded view of the massage device as shown in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Additionally, some terms used in this specification are more specifically defined below.

The description will be made as to the embodiments of the present invention in conjunction with the accompanying drawings in FIGS. 1-6. In accordance with the purposes of this invention, as embodied and broadly described herein, this invention, in one aspect, relates to a massage device that utilizes a hoist transmission mechanism to provide massaging effects.

Referring first to FIGS. 1-6, a massage device 100 is shown according to one embodiment of the present invention. The massage device 100 includes a base cover 110, a carriage 130, a transmission assembly 140 and a massage assembly having a pair of massage members 150.

The base cover 110 has a first end portion 113, an opposite, second end portion 114, a longitudinal axis 111 and two guiding rails 112 formed parallel to the longitudinal axis 111. The two guiding rails 112 are adapted for cooperating with the carriage 130 and translating the pair of massage members 150 along the longitudinal axis 111. Other numbers of guiding rails can also be utilized to practice the present invention. The base cover 110 may also have a series of ribs 113 and supporting structures 114 for supporting and securing a top cover (cushion) 118 to form a housing for accommodating the carriage 130, the transmission assembly 140 and the massage assembly therein. The base cover 110 is made of a durable material, such as wood, plastic, alloy or the like.

The carriage 130 includes a chassis member 131 having a first surface 131*a* and an opposite, second surface 131*b*, and a shield member 132 having a first surface 132*a* and an opposite, second surface 132*b*. The shield member 132 is placed over the chassis member 131 to form a chamber 133 between the second surface 131*b* of the chassis member 131 and the first surface 132*a* of the shield member 132. The chassis member 131 has two grooves 134 spaced-apart and formed on the first surface 131*a* of the chassis member 131. The two grooves 134 are configured and sized to receive the two guiding rails 112 of the base cover 110, respectively. The cooperation of the guiding rails 112 of the base cover 110 and the grooves 134 of the chassis member 131 provides longitudinal guidance and support to the carriage 130 as it translates along the guiding rails 112. That is, when the carriage 130 is engaged with the base cover 110, the guiding rails 112 are respectively received in the grooves 134 of the chassis member 131, respectively, and the carriage 130 is longitudinally movable back and forth along the plurality of guiding rails 112 of the base cover 110. Other numbers of grooves can also be utilized to practice the present invention. The number of grooves is corresponding to the number of guiding rails formed in the base cover 110. Additionally, the carriage 130 also has a pair of receiving member 135. Each receiving member 135 has a pair of bolt shafts 136 protruded from the second surface 132*b* of the shield member 132 and a bore 137 formed through the first surface 132*a* and the second surface 132*b* of the shield member 132. Each receiving member 135 may also have a wall structure 138 protruded from the second surface 132*b* of the shield member 132 and surrounding the protrusions 136 and the bore 137 therein.

The transmission assembly 140 is received in the chamber 133 and secured in the carriage 130. The transmission assembly 140 includes a motor 141 having an output shaft 141*a*, a worm 142 mechanically coupled with the output shaft 141*a* of the motor 141, a pair of first worm wheels 143*a* and 143*b* meshing with the worm 142, a pair of second worm wheels 144*a* and 144*b* each meshing with a corresponding one of the pair of first worm wheels 143*a* and 143*b*, a first gear 144 coaxially mounted under one of the pair of second worm wheels 144*a* or 144*b*, a second gear 145 meshing with the first gear 144, a third gear 146 meshing with the second gear 145.

The transmission assembly 140 also includes a hoist transmission mechanism that has a reel wheel 147 coaxially mounted to the third gear 146, a pair of pulleys 148 respectively mounted to the first end portion 113 and the second portion 114 of the base cover 110, and a cable 149 routed over the pair of pulleys 148 and wound on the reel wheel 147, thereby defining a first distance. L1, between the reel wheel 147 and one of the pair of pulleys 148, a second distance, L2, between the reel wheel 147 and the other of the pair of pulleys 148, and a third distance, L3, between the pair of pulleys 148, such that when the reel wheel 147 rotates, it causes one of the first distance L1 and the second distance L2 to be decreased, while the other of the first distance L1 and the second distance L2 to be increased, where L1+L2=L>L3. In one embodiment, the cable is made of a durable material such as leather, plastic, steel, alloy, or the like.

Under this arrangement, when the motor 141 is activated, it drives the worm 142 to rotate, the rotation of the worm 142 results in, in turn, the rotations of the pair of first worm wheels 143*a* and 143*b*, the pair of second worm wheels 144*a* and 144*b*, the first gear 144, the second gear 145, and the third gear 146, and the reel wheel 147, the rotation of the reel wheel 147 causes one of the first distance L1 and the second distance L2 to be decreased, while the other of the first distance L1 and the second distance L2 to be increased, thereby moving the carriage 130 along the plurality of the guiding rails of the base cover 110.

The massage assembly has a pair of massage members 150. Each massage member 150 has a gear shaft 151, a driving member 160, a massage bracket 152, and a pair of massage heads 157.

Figure 3:
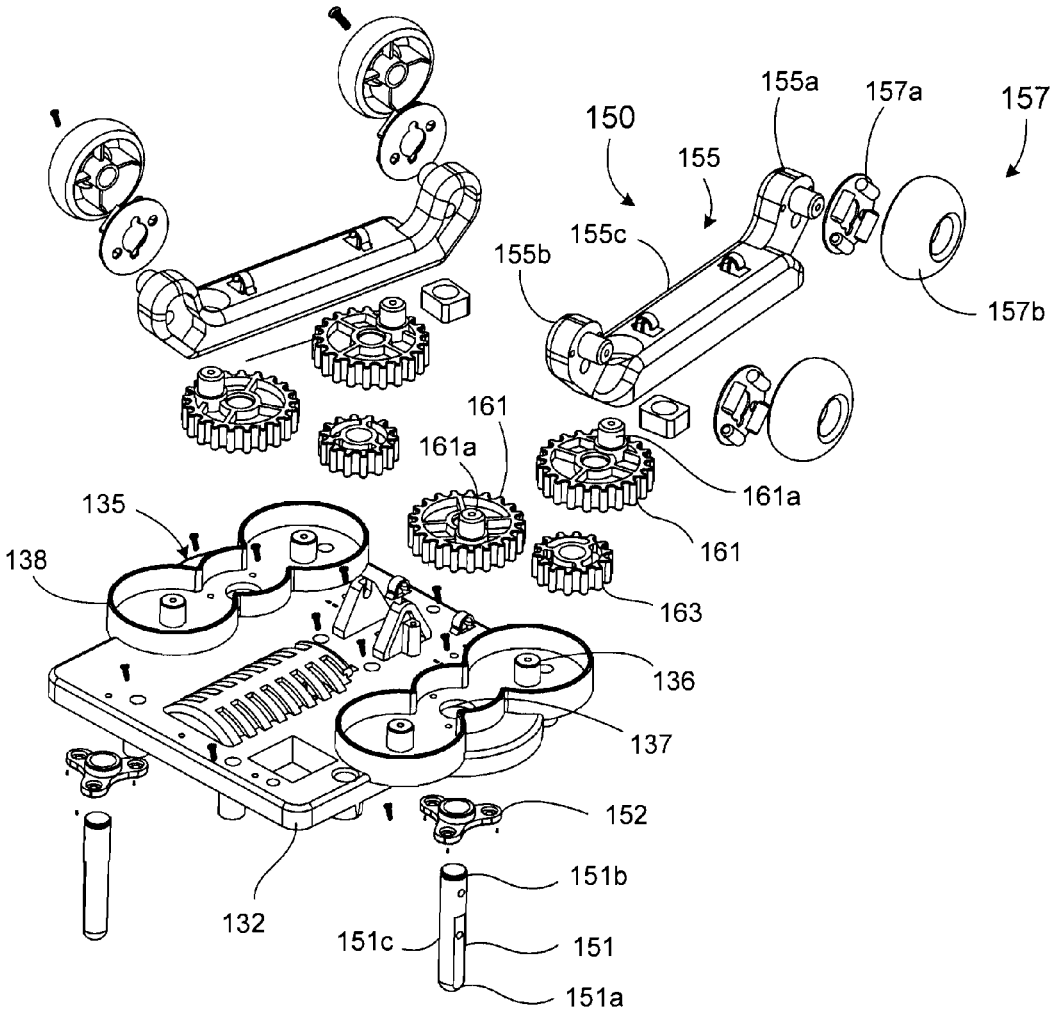
FIG. 3 shows another partially exploded view of the massage device as shown in FIG. 1.

As shown in FIG. 3, the driving member 160 includes a pair of eccentric gears 161 and a driving gear 163, configured such that when the driving member 160 is received in a corresponding receiving member 135 of the carriage 130, each of the pair of eccentric gears 161 is coaxially and rotatably engaged with a corresponding bolt shaft 136 of the receiving member 135 of the carriage 130, and the driving gear 163 meshes with the pair of eccentric gears 161. Additionally, each of the pair of eccentric gears 161 has a protrusion 161 a protruded at an eccentric position.

The gear shaft 151 has a first end portion 151 a and an opposite, second end portion 151*b* defining a shaft body 151*c* therebetween. As assembled, the shaft body 151*c* extends through the bore 137 of the corresponding receiving member 135 of the carriage 130, while the first end portion 151*a* and the second end portion 151*b* are coaxially mounted to the driving gear 163 of the driving member 160 and the corresponding second worm wheel 144*a* or 144*b* of the transmission assembly 140, respectively.

Figure 4:
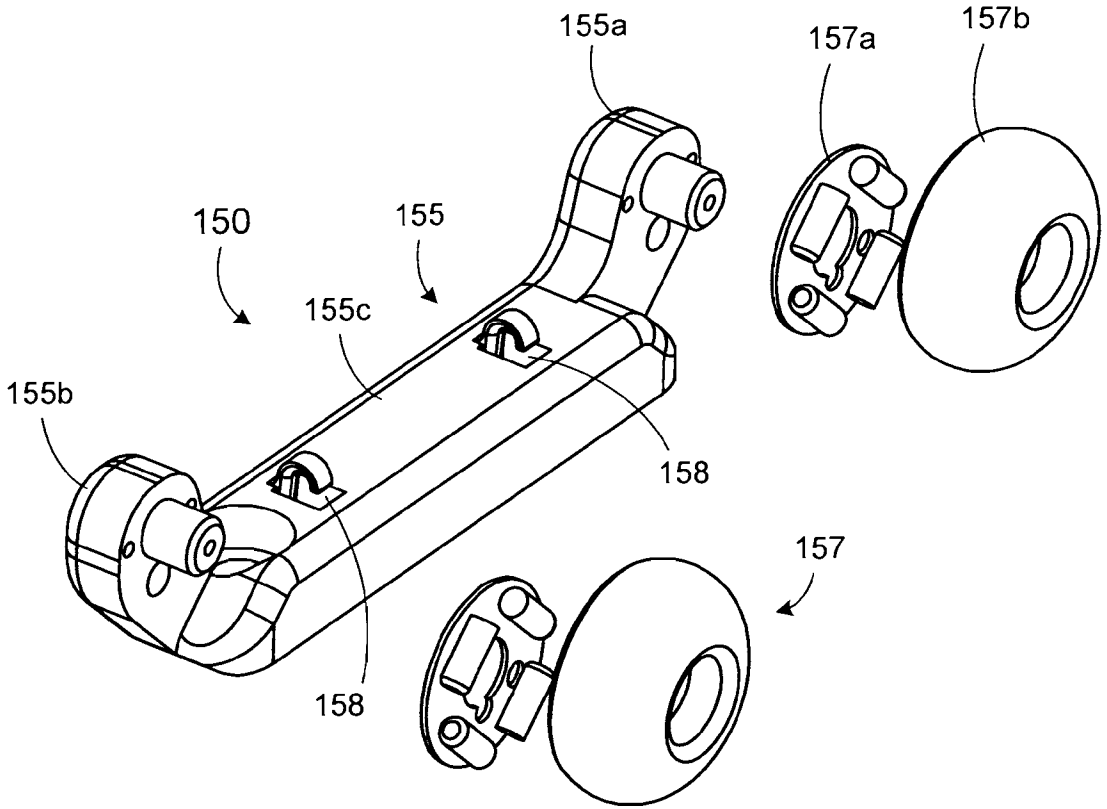
FIG. 4 shows a partially exploded view of a massage member utilized in the massage device as shown in FIG. 1.
Figure 5:
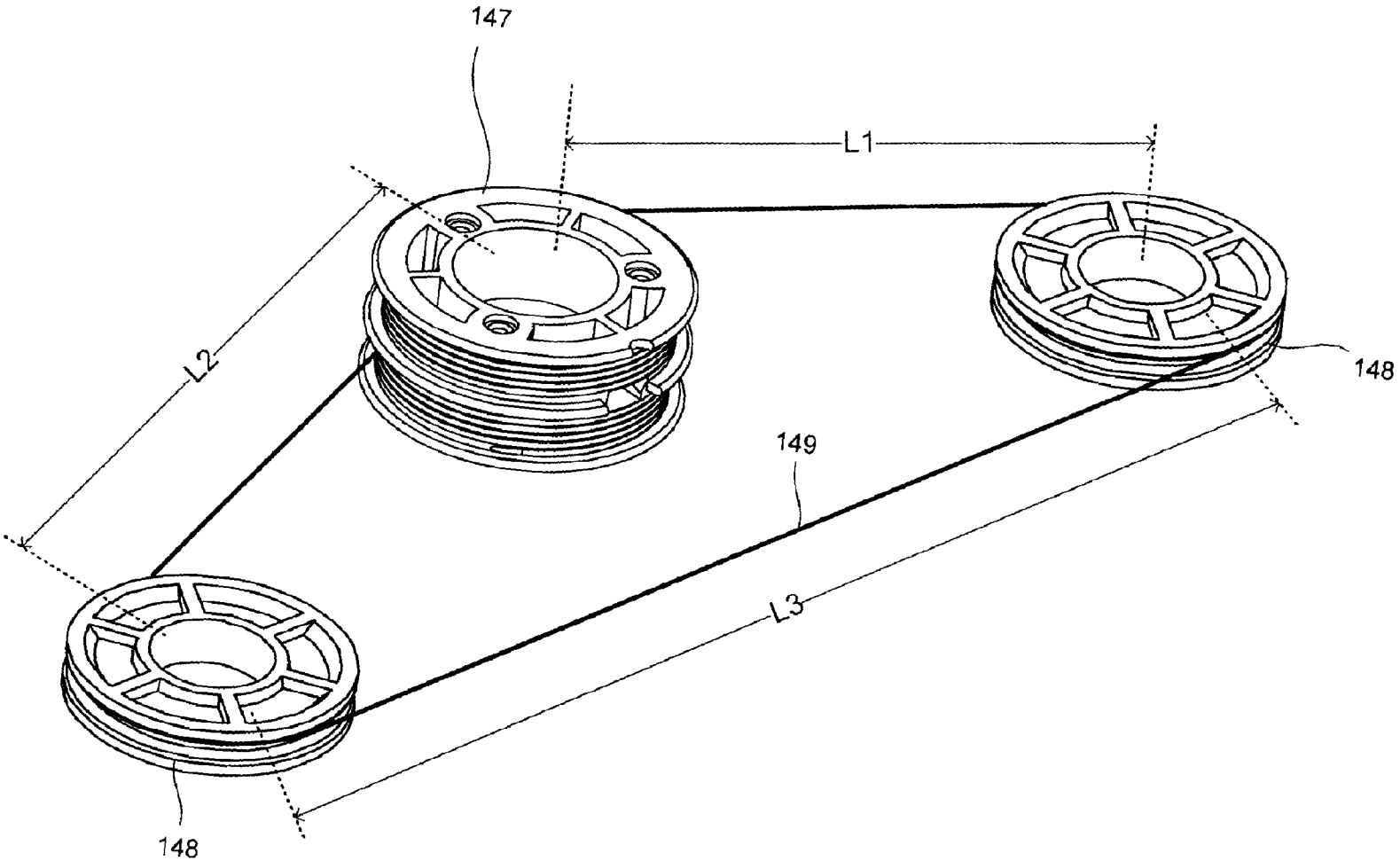
FIG. 5 shows a perspective view of a hoist transmission mechanism utilized in the massage device as shown in FIG. 1.
Figure 6:
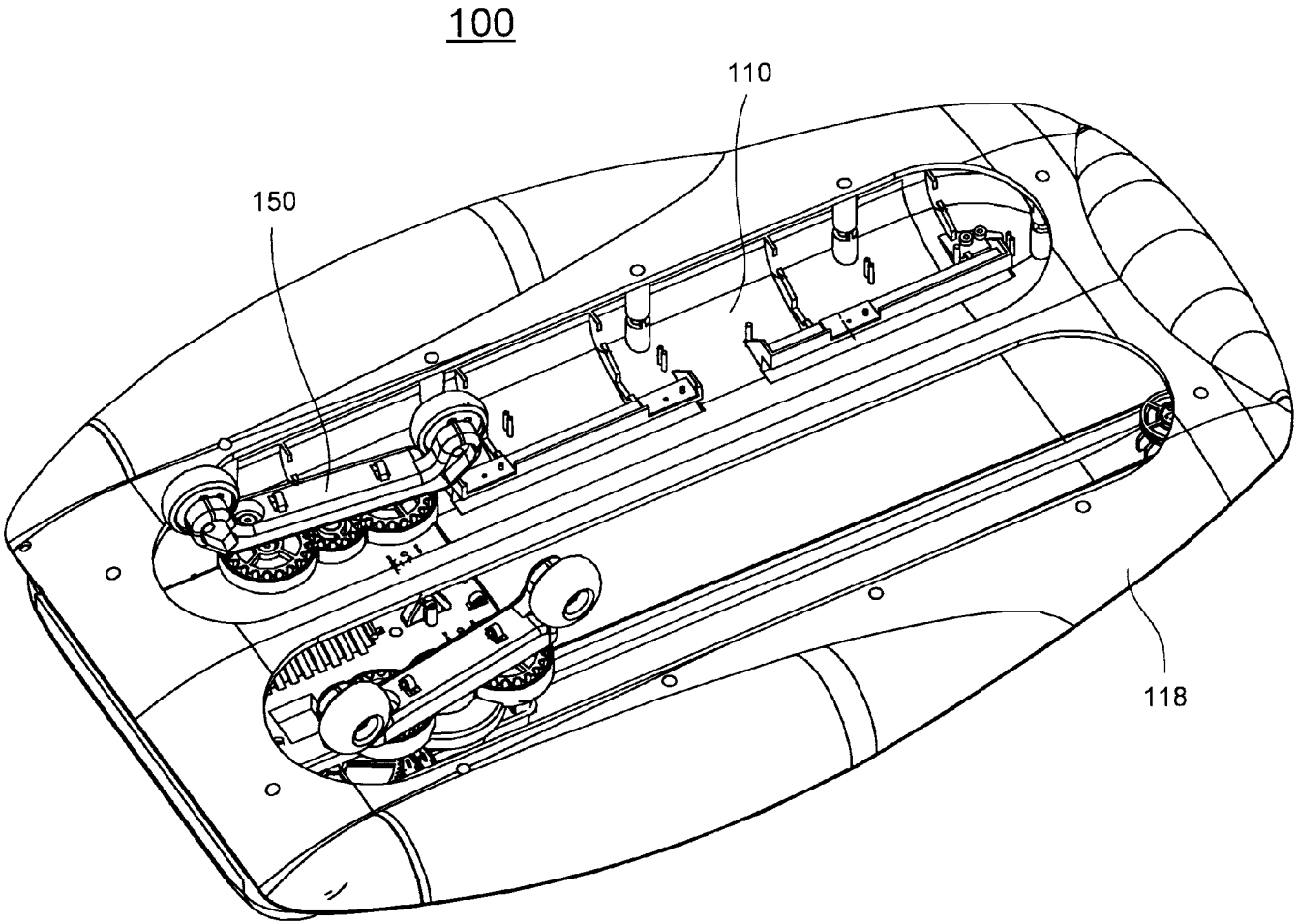
FIG. 6 shows a perspective view of the massage device as shown in FIG. 1.

As shown in FIG. 4, the massage bracket 155 has a first end portion 155*a* and a second portion 155*b* defining a bracket body 155*c* therebetween. The bracket body 152*c* defines a pair of openings 154. Both the first and second end portions 155*a* and 155*b* are bent towards a direction that is perpendicular to the bracket body 155*c*. When the massage bracket 155 is attached to the driving member 160, the protrusion 161 of each of the pair of eccentric gears 161 of the driving member 160 is received in a corresponding opening 154 in the bracket body 152*c*.

The pair of massage heads 157 is mounted to the first end portion 155*a* and the second end portion 155*b*, respectively, of the massage bracket 155. In one embodiment, each massage head 157 may have a mushroom-shape or the like. The massage head 157 may include a structure 157*a* and a mushroom-shape node 157*b* for housing the structure 157*a* therein. The massage head 157 may also have an energy source of capable of generating at least one thermal energy and photonic energy. For example, the source energy includes a lamp base, a PCB board attached to the lamp base, and heating lamps attached onto the PCB board.

Under this arrangement, when the corresponding second worm wheel 144*a* or 144*b* rotates, it causes the gear shaft 151 to rotate, the rotation of the gear shaft 151 results in, in turn, the rotation of the driving gear 163 and the pair of eccentric gears 161, the rotation of pair of eccentric gears 161 drives the pair of massage heads to move synchronically in a circle, thereby providing a kneading effect to a user.

For the massage device 100, in operation, the motor 141 drives the worm 142 to rotate, the rotation of the worm 142 results in, in turn, the rotations of the pair of first worm wheels 143*a* and 143*b*, the pair of second worm wheels 144*a* and 144*b*, the first gear 144, the second gear 145, and the third gear 146, and the reel wheel 147. The rotation of the reel wheel 147 causes one of the first distance L1 and the second distance L2 to be decreased, while the other of the first distance L1 and the second distance L2 to be increased, thereby moving the carriage 130 along the plurality of the guiding rails 112 of the base cover 110. Meanwhile, the rotation of the corresponding second worm wheel 144*a* or 144*b* results in, in turn, the rotation of the gear shaft 151, the driving gear 163 and the pair of eccentric gears 161. The rotation of pair of eccentric gears 161 drives the pair of massage heads to move synchronically in a circle. When the massage heads 157 are applied to parts of the body of a user, a simulated kneading effect is provided.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A massage device, comprising:

(a) a base cover having a first end portion and an opposite, second end portion, a longitudinal axis and a plurality of guiding rails formed parallel to the longitudinal axis;

(b) a carriage having:

(i) a chassis member having a first surface and an opposite, second surface;

(ii) a shield member having a first surface and an opposite, second surface;

(iii) a chamber defined between the second surface of the chassis member and the first surface of the shield;

(iv) a plurality of grooves formed in the first surface of the chassis member; and (v) a pair of receiving member each having a pair of bolt shafts protruded from the second surface of the shield member and a bore formed through the first surface and the second surface of the shield member, wherein when the carriage is engaged with the base cover, the plurality of guiding rails is received in the plurality of grooves of the chassis member, respectively, and the carriage is longitudinally movable back and forth along the plurality of guiding rails of the base cover;

(c) a transmission assembly received in the chamber and secured in the carriage, having:

(i) a motor having an output shaft;

(ii) a worm mechanically coupled with the output shaft of the motor;

(iii) a pair of first worm wheels meshing with the worm;

(iv) a pair of second worm wheels each meshing with a corresponding one of the pair of first worm wheels;

(v) a first gear coaxially mounted under one of the pair of second worm wheels;

(vi) a second gear meshing with the first gear;

(vii) a third gear meshing with the second gear; and (viii) a hoist transmission mechanism having a reel wheel coaxially mounted to the third gear, a pair of pulleys respectively mounted to the first end portion and the second portion of the base cover, and a cable routed over the pair of pulleys and wound on the reel wheel, thereby defining a first distance. L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased, while the other of the first distance L1 and the second distance L2 to be increased, wherein L1+L2=L≧L3, wherein when the motor is activated, it drives the worm to rotate, the rotation of the worm results in, in turn, the rotations of the pair of first worm wheels, the pair of second worm wheels, the first gear, the second gear, and the third gear, and the reel wheel, the rotation of the reel wheel causes one of the first distance L1 and the second distance L2 to be decreased, while the other of the first distance L1 and the second distance L2 to be increased, thereby moving the carriage along the plurality of the guiding rails of the base cover; and (d) a massage assembly having a pair of massage members, each massage member having:

(v) a driving member having a pair of eccentric gears and a driving gear, configured such that when the driving member is received in a corresponding receiving member of the carriage, each of the pair of eccentric gears is coaxially and rotatably engaged with a corresponding one bolt shaft of the receiving member and meshed with the driving gear, wherein each of the pair of eccentric gears has a protrusion protruded at an eccentric position;

(vi) a gear shaft extending through the bore of the corresponding receiving member of the carriage, having a first end portion and an opposite, second end portion coaxially mounted to the driving gear and the corresponding second worm wheel, respectively;

(vii) a massage bracket having a first end portion and a second portion defining a bracket body therebetween, wherein the bracket body defines a pair of openings, such that when the massage bracket is attached to the driving member, the protrusion of each of the pair of eccentric gears of the driving member is received in a corresponding opening; and (viii) a pair of massage heads mounted to the first end portion and the second end portion, respectively, of the massage bracket, wherein when the corresponding second worm wheel rotates, it causes the gear shaft to rotate, the rotation of the gear shaft results in, in turn, the rotation of the driving gear and the pair of eccentric gears, the rotation of pair of eccentric gears drives the pair of massage heads to move synchronically in a circle, thereby providing a kneading effect to a user.

2. The massage device of claim 1, wherein the cable is made of leather, plastic, steel, or alloy.

3. The massage device of claim 1, wherein each of the pair of massage heads has a mushroom-shape.

4. The massage device of claim 3, wherein each of the pair of massage heads comprises a structure and a mushroom-shape node housing the structure.

5. The massage device of claim 1, wherein each of the pair of massage heads comprises an energy source of capable of generating at least one thermal energy and photonic energy.

6. The massage device of claim 5, wherein the source energy comprises a lamp base, a PCB board attached to the lamp base, and heating lamps attached onto the PCB board.

7. A massage device, comprising:

(a) a massage assembly having a pair of massage members, each massage member having:

(i) a massage bracket having a first end portion and a second portion defining a bracket body therebetween, wherein the bracket body defines a pair of openings;

(ii) a driving member having a pair of eccentric gears and a driving gear meshing with the pair of eccentric gears, wherein each of the pair of eccentric gears has a protrusion protruded at an eccentric position, wherein the protrusion of the eccentric gear is received in a corresponding opening of the massage bracket; and (iii) a pair of massage heads mounted to the first end portion and the second end portion, respectively, of the massage bracket; and (b) a transmission assembly adapted for driving each massage head of the massage assembly to move along a circle, while translating the massage assembly along a direction parallel to the planar of the circle.

8. The massage device of claim 7, further comprising:

(a) a base cover having a firs end portion and an opposite, second end portion, a longitudinal axis and a plurality of guiding rails formed parallel to the longitudinal axis; and (b) a carriage having (i) a chassis member having a first surface and an opposite, second surface;

(ii) a shield member having a first surface and an opposite, second surface;

(iii) a chamber defined between the second surface of the chassis member and the first surface of the shield;

(iv) a plurality of grooves formed in the first surface of the chassis member; and (v) a pair of receiving member each having a pair of bolt shafts protruded from the second surface of the shield member and a bore formed through the first surface and the second surface of the shield member, wherein when the carriage is engaged with the base cover, the plurality of guiding rails is received in the plurality of grooves of the chassis member, respectively, and the carriage is longitudinally movable back and forth along the plurality of guiding rails of the base cover.

9. The massage device of claim 8, wherein the transmission assembly received in the chamber and secured in the carriage, comprising:

(a) a motor having an output shaft;

(b) a worm mechanically coupled with the output shaft of the motor;

(c) a pair of first worm wheels meshing with the worm;

(d) a pair of second worm wheels each meshing with a corresponding one of the pair of first worm wheels;

(e) a first gear coaxially mounted under one of the pair of second worm wheels;

(f) a second gear meshing with the first gear;

(g) a third gear meshing with the second gear; and (h) a hoist transmission mechanism having a reel wheel coaxially mounted to the third gear, a pair of pulleys respectively mounted to the first end portion and the second portion of the base cover, and a cable routed over the pair of pulleys and wound on the reel wheel, thereby defining a first distance. L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased, while the other of the first distance L1 and the second distance L2 to be increased, wherein L1+L2=L≧L3, wherein when the motor is activated, it drives the worm to rotate, the rotation of the worm results in, in turn, the rotations of the pair of first worm wheels, the pair of second worm wheels, the first gear, the second gear, and the third gear, and the reel wheel, the rotation of the reel wheel causes one of the first distance L1 and the second distance L2 to be decreased, while the other of the first distance L1 and the second distance L2 to be increased, thereby moving the carriage along the plurality of the guiding rails of the base cover.

10. The massage device of claim 9, wherein each massage member further comprises a gear shaft extending through the bore of the corresponding receiving member of the carriage, having a first end portion and an opposite, second end portion coaxially mounted to the driving gear and the corresponding second worm wheel, respectively.

11. The massage device of claim 10, wherein in operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the pair of massage heads to move along a circle, thereby providing a kneading effect to a user.

12. The massage device of claim 7, wherein each of the plurality of massage heads comprises an energy source of capable of generating at least one of thermal energy and photonic energy.

13. The massage device of claim 7, wherein the cable is made of leather, plastic, steel, or alloy.

14. The massage device of claim 7, wherein each of the pair of massage heads has a mushroom-shape.

15. The massage device of claim 14, wherein each of the pair of massage heads comprises a structure and a mushroom-shape node housing the structure.

16. A massage device, comprising:

(a) a massage assembly having a plurality of massage heads; and (b) a transmission assembly having a first transmission mechanism and a second transmission mechanism having a reel wheel coupled to the first transmission, a pair of pulleys spatially mounted to a base cover, and a cable routed over the pair of pulleys and wound on the reel wheel, thereby defining a first distance. L1, between the reel wheel and one of the pair of pulleys, a second distance, L2, between the reel wheel and the other of the pair of pulleys, and a third distance, L3, between the pair of pulleys, such that when the reel wheel rotates, it causes one of the first distance L1 and the second distance L2 to be decreased, while the other of the first distance L1 and the second distance L2 to be increased, wherein L1+L2=L≧L3, wherein the first transmission mechanism is coupled to the massage assembly so as to drive each massage head of the massage assembly to move along a circle, and also drive the reel wheel of the second transmission mechanism to rotate, thereby translating the massage assembly along a direction parallel to the planar of the circle.

17. The massage device of claim 16, wherein the first transmission mechanism comprises:

(a) a motor having an output shaft;

(b) a worm mechanically coupled with the output shaft of the motor;

(c) a pair of first worm wheels meshing with the worm;

(d) a pair of second worm wheels each meshing with a corresponding one of the pair of first worm wheels;

(e) a first gear coaxially mounted under one of the pair of second worm wheels;

(f) a second gear meshing with the first gear; and (g) a third gear meshing with the second gear, wherein the reel wheel of the second transmission mechanism is coaxially mounted to the third gear; and wherein when the motor is activated, it drives the worm to rotate, the rotation of the worm results in, in turn, the rotations of the pair of first worm wheels, the pair of second worm wheels, the first gear, the second gear, and the third gear, and the reel wheel.

18. The massage device of claim 17, wherein the massage assembly further comprises:

(a) at least one massage bracket having a first end portion and a second portion defining a bracket body therebetween, wherein the plurality of massage heads is mounted to the first and second end portions, and wherein the bracket body defines a pair of openings; and (b) at least one driving member having a pair of eccentric gears and a driving gear meshing with the pair of eccentric gears, wherein each of the pair of eccentric gears has a protrusion a protruded at an eccentric position that is received in a corresponding opening of the massage bracket.

19. The massage device of claim 18, wherein the massage assembly further comprises a gear shaft, having a first end portion and an opposite, second end portion coaxially mounted to the driving gear of the driving member and the corresponding second worm wheel of the first transmission mechanism, respectively.

20. The massage device of claim 19, wherein in operation, the motor drives the pair of worm wheels to rotate in opposed rotational directions, which in turn, drives the carriage to move along the plurality of the guiding rails of the base cover and the driving member of the massage assembly to rotate, the rotation of the driving member of the massage assembly drives the pair of massage heads to move along a circle, thereby providing a kneading effect to a user.

* * * * *